United States Patent [19]

Murakami et al.

[11] 4,395,283

[45] Jul. 26, 1983

[54] METHOD OF SWITCHING BOTTOM-BLOWN GASES AND APPARATUS THEREFOR

[75] Inventors: Shozo Murakami; Hukuyosi Isomura; Yoshihiro Koga, all of Kitakyushu, Japan

[73] Assignee: Nippon Steel Corporation, Tokyo, Japan

[21] Appl. No.: 351,094

[22] Filed: Feb. 23, 1982

[30] Foreign Application Priority Data

Feb. 27, 1981 [JP] Japan ..... 56-26978

[51] Int. Cl.[3] ..... C21C 5/34

[52] U.S. Cl. ..... 75/60; 75/59; 266/47; 266/89

[58] Field of Search ..... 75/59, 60; 266/47, 89

[56] References Cited

U.S. PATENT DOCUMENTS

| | | | |
|---|---|---|---|
| 3,992,194 | 11/1976 | Leroy | 75/60 |
| 3,997,334 | 12/1976 | Dlubek | 75/60 |
| 4,045,214 | 8/1977 | Wetzel | 75/60 |
| 4,047,937 | 9/1977 | Kolb | 75/60 |
| 4,050,681 | 9/1977 | Brotzmann | 75/60 |
| 4,272,286 | 6/1981 | Schempp | 75/60 |

*Primary Examiner*—P. D. Rosenberg

*Attorney, Agent, or Firm*—Pollock, Vande Sande & Priddy

[57] ABSTRACT

A method of switching bottom blown gases and an apparatus suitable for carrying such method into practice in blowing successively in turn a plurality of gases through piping into molten steel in a steel-making furnace through tuyeres or porous plugs for gas blowing located in a lower portion of the steel-making furnace. The method includes the step of directly releasing into atmosphere at least a portion of the gas flowing in and through the piping in response to a rise in the pressure of the gas when switching the blown gases.

8 Claims, 1 Drawing Figure

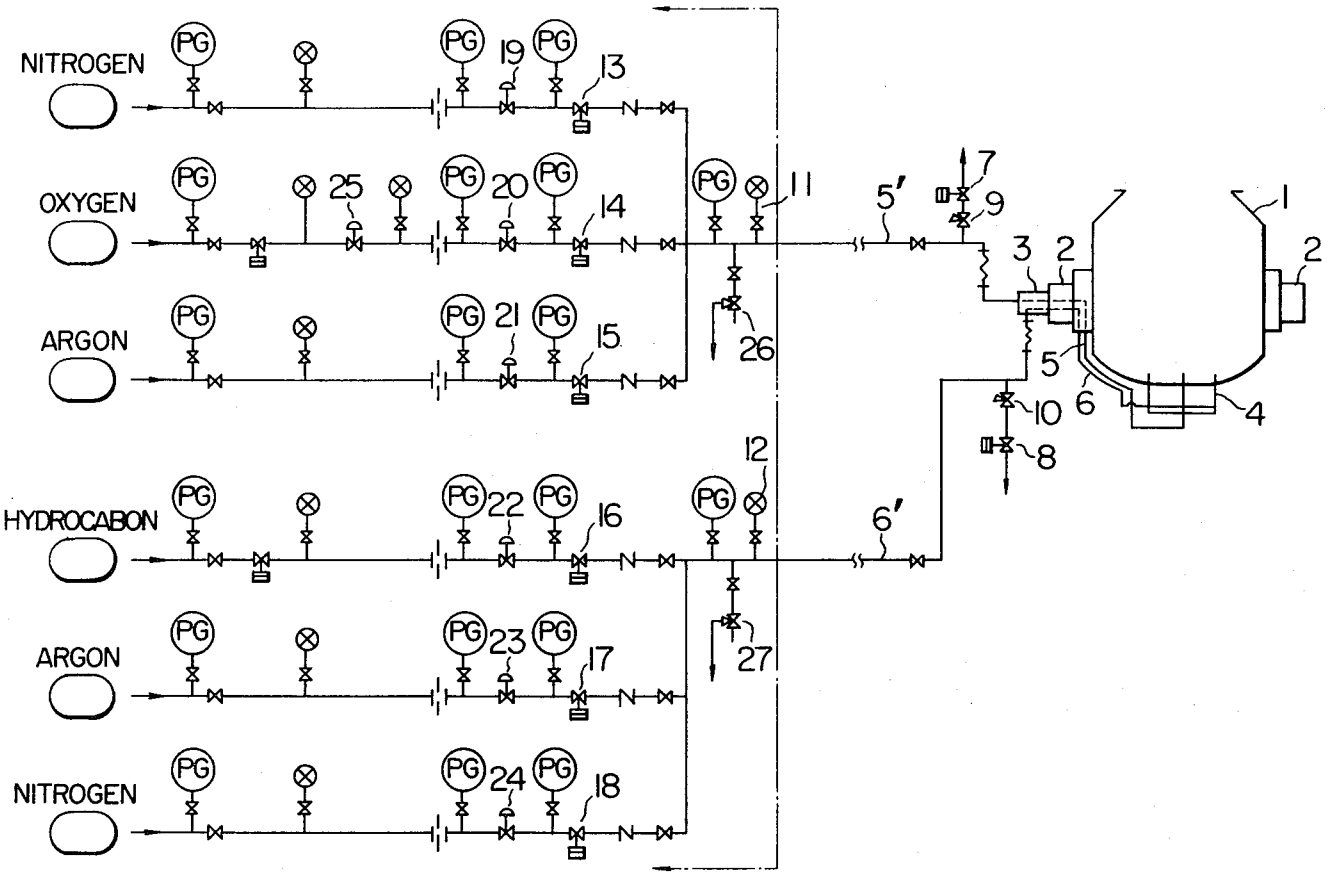
NITROGEN
OXYGEN
ARGON
HYDROCARBON
ARGON
NITROGEN
PG

METHOD OF SWITCHING BOTTOM-BLOWN GASES AND APPARATUS THEREFOR

This invention relates to a method of switching bottom-blown gases used in a steel-making furnace, such as a converter, and an apparatus for carrying out such a process It is publicly known that various proposals have been made for improving reaction efficiency in producing steel from pig iron by refining. Such proposals include the provision of a tuyere for bottom-blown gases at a portion of the steel making furnace below the surface of a molten steel level (hereinafter referred to as bottom-blowing tuyere) and the use of a method for blowing all the volume of oxygen necessary for refining through the bottom-blowing tuyere (generally referred to as an OBM, Q-BOP or LWS process), a method of blowing a part of the oxygen necessary for refining through the bottom-blowing tuyere (oxygen to-and-bottom-blown converter), or a method of refining by carrying out, as one step of the method, bottom-blowing of a small amount of argon, nitrogen gas, air or $CO_2$ or a mixture of these gases introduced in a conventional top blown converter from a position below the surface of a molten metal (so-called combined blowing). In carrying out blowing the bottom-blown gas, porous plugs or single pipe tuyeres or annular tuyeres are used depending on the characteristics of the blown gases.

It is usual practice to switch these bottom-blown gases in accordance with purposes of refining or as the steps of operation progresses from one to next. Particularly, in switching the bottom-blown gases in accordance with the purpose of refining while the refining by blowing gas is being carried out or when molten steel and slag are in a furnace, it is a very important problem that should be improved how to rapidly effect switching of bottom-blown gases or how to replace the old gas remaining in a piping completely by other new gas, in order to efficiently and effectively accomplish the object of refining without causing the damage, for example, of the bottom-blowing tuyere (or the plug). The present invention provides a very effective method for improving this problem.

Generally, for supplying bottom-blown gases to a converter, a control device for the gases used which includes a pressure controlling valve, a flow controlling valve or other controlling and regulating instruments, all of which are conventional. These devices are installed in what is referred to as a valve station. On the other hand the converter is equipped with various and other important steel making utilities installations. Thus, since difficulties are usually experienced in leaving a space for installing a valve station in the vicinity of the converter, it is usual to install the valve station in a position a fairly long distance apart the converter, so that the piping connecting the valve station to the converter has a length of at least several tens of meters or over 100 meters in some cases. However, the switching of bottom-blown gases which is carried out during refining or as the steps of operation progresses, can be achieved by switching valves for controlling bottom-blown gases installed in the valve station. Therefore, in order that the gas ejected or blown, before switching is effected, through the porous plugs or tuyeres located blow the surface of the molten steel in the converter may be completely switched by a next gas, it is required that the gas existing in the piping from the valve station to the plugs or tuyeres be replaced by the next gas immediately after the switching of the valves.

To enable replacing gas remaining between the valve station and the tuyeres to be quickly and completely carried out at the time of switching of the gases it is naturally advantageous to minimize the capacity of the piping between the valve station and the tuyere. On the other hand, it is necessary to keep the capacity of the piping at a certain level to ensure that the pressure loss of the gas in the piping is kept below a certain level to minimize the gas supply pressure of a gas source, and to prevent combustion or explosion from occurring in the piping particularly in the case of the presence of industrial pure oxygen. Thus one is faced with the need to simultaneously meet the conflicting requirements. However, it would be impossible to simultaneously meet these conflicting requirements. Thus the present practice in ordinary piping design is to ensure, while by-passing the point of improving the problem caused in replacing the gas in the piping by another gas when the capacity of the piping is large, that the piping has a capacity large enough to keep the flow velocity of gas in the piping smaller than a predetermined value permitted to the particular kind of gas, and at the same time to keep the pressure loss in the piping below a predetermined value allowed for a given supply pressure of the gas source.

The result of such piping design is that when the gas switching is carried out for the bottom-blown gases, it takes a relatively long time to effect gas replacements in comparison with the case of the piping capacity being small. This is accounted for by the fact that the pressure of the bottom-blown gas reaches several $kg/cm^2$ to about 10 $kg/cm^2$ and sometimes 10 odds $kg/cm^2$ during operation, so that the gas remaining in the piping that should be replaced becomes a substantially large volume in proportion to the pressure of the bottom-blown gas during operation. As a result, effecting complete gas replacements takes from several scores of seconds to over 1 minute in usual practice. The fact that gas replacements take a long time causes serious problems particularly when the switchng of bottom-blown gases is carried out in during the refining process.

One example of the problem occurs when pig iron is refined to steel by use of a converter provided at the bottom thereof with annular tuyeres, each having an inner pipe and an outer pipe from which oxygen and hydrocarbon as a cooling agent are blown during refining. In this case, the hydrogen absorbed and dissolved in molten metal during the flowing of hydrocarbon into the molten metal through the outer pipe of the annular tuyeres usually reaches a level between 3 and 7 ppm. Thus, to reduce the hydrogen, it is a usual practice to switch the oxygen to argon regarding the inner pipe and to switch the hydrocarbon to argon regarding the outer pipe to subject the molten steel to bubbling with argon (which is usually referred to as rinsing) at the terminating stages of refining or prior to the discharge of molten steel off the converter. To carry out hydrogen removal effectively and efficiently, it is important to purge the hydrocarbon remaining in the piping between the valve station and the tuyeres as quickly and completely as possible immediately after the switching of gases, by replacing the same by argon. The more quickly the hydrocarbon in the piping is purged off, the less the content of hydrogen in molten metal becomes. In other words, during the time that is required for replacing the hydrocarbon in the piping by the argon, a hydrogen source is being supplied to the molten metal from the hydrocarbon existing still in the piping, so that dehydrogenation does not essentially take place. Thus actual time required for carrying out dehydrogenation is extended by a time required for replacing the hydrocarbon in the piping by argon, and this not only prolongs the time required for making steel in a converter and causes a reduction in efficiency but also causes a temperature drop of the molten steel, due to prolongation of the time of treatment for hydrogen removal. It has been ascertained by the inventors from actual experiences that not only the refining operation is seriously affected by the delay in replacing one gas by another gas blown through the bottom-blown tuyere but also the service life of the annular tuyere is adversely affected thereby.

According to the inventor'experiences, the sectional area of the tuyere for bottom-blowing, particularly that of the annular gap at the forward end of tuyeres, which essentially defines a gas passageway and is generally referred to as effective opening degree, is not constant and usually changes irregularly as time elapses. This causes the time required for replacing the gas in the piping by another gas to vary greatly, and the aforesaid unfavorable problem varies in degree each time the treatment of hydrogen removal is carried out. Thus the operation of effecting bottom-blown gas replacements is performed in what one might say a groping-one's-way-in-the-dark manner without definite guide-lines. Those skilled in the art have faced difficulties in improving the problem, that is, the improvement in the above-described problem regarding the operation of a converter for increasing operational efficiency to increase productivity has been quite difficult to perform.

The hydrogen removing treatment referred to hereinabove is one example of how important it is to effect rapid and complete replacements of bottom-blown gases. The problem a how to carry out bottom-blown gas replacement successfully is not of unique one only regarding treatment for hydrogen removal. The same kind of problem is also encountered in other treatments, such as in a case of treatment for adding nitrogen to the molten metal, and in another case of effective application of bottom-blown gas such as blowing inert gas or a mixture of inert gas and oxygen into molten metal in a converter for producing ultralow carbon steel.

This invention has been developed for the purpose of improving the aforesaid problem encountered in the prior art. Accordingly the invention has as its object the provision for improving the fundamental problem inherent in the case of replacing the gas in the piping from the valve station to the tuyere for bottom-blowing by another gas when bottom-blown gas switching is effected, by means of gas relief valves mounted on the piping.

Additional and other objects, features and advantages of the invention will become apparent from the description of a preferred embodiment of the invention set forth hereinafter when considered in conjunction with the accompanying drawing, in which:

The sole drawing is a piping drawing showing the flow of gases one of which is blown through the inner pipe of the annular tuyere, another of which gases is blown through the outer pipe of the tuyere.

The specific contents of the invention will now be described in detail by referring to one embodiment and which proves that the invention can achieve marked effects. The embodiment deals with a converter with a capacity of 150 tons for producing steel from pig iron by refining in which a part of the oxygen for refining is bottom-blown and the rest or the majority thereof is top-blown, in the same manner as in the case of conventional top-blown LD converter.

The sole drawing shows the flow of gases supplied into the outer and inner pipes of each of annular tuyeres arranged at the bottom of the converter, the construction of which annular tuyere is shown in Japanese Patent Publication Nos. 20443/89 and 30441/77.

As shown each of the gases one of which is to be fed to the outer pipe of the tuyere another of which is to be fed to the inner pipe thereof flows through first pipings connected to gas sources and a second piping connected to one of the outer and inner pipes and all of the first piping. The first and second pipings disposed outward of the converter and the outer and inner pipes in the converter side are connected to each other through a rotary joint 3 mounted on a trunnion shaft 2, so that the converter 1 itself can be rotated freely about the trunnion shaft 2. In the drawing, each of the inner pipe 5 and the outer pipe 6 is connected to a single system of piping respectively for supplying gases to the converter 1. However, the invention is not limited to this gas supply system and each tuyere may have a system of piping of its own to enable individual control to be effected in supplying gases through a plurality of inner and outer pipes, or through a plurality of inner or outer pipes and one outer or inner pipe without departing from the scope of the invention. Except for the features of the invention, the system of gas flow from the valve station to the converter is similar to conventional one for blowing gas through the bottom of a converter now practised generally in the art.

The features of the invention comprise gas relief valves 7 and 8 mounted in each of the second pipings 5', 6' connected to the inner and outer pipe 5, 6, respectively, through the rotary joint 3. To accomplish the object of the invention, it is desirable to mount the gas relief valves 7 and 8 as close as possible to the tuyeres located at the bottom of the converter 1. However, in a practical point of view, in the embodiment shown and described herein, they are located in a terminal end portion of each system of pipings 5', 6' disposed outward of the converter which end portion is in the vicinity of the rotary joint 3 so that they may be mounted relatively readily and may be serviced with ease. The relief valves 7 and 8 mounted in each pipings 5', 6' connected to the inner and outer pipes 5, 6 are provided with needle valves 9 and 10 respectively for setting beforehand the flow rates of gases to be released when the respective gas relief valves are opened. Replaceable fixed orifice can also be used instead of the needle valve. Each of the pipings connected to the inner and outer pipes 5, 6 is provided with pressure gauges 11 and 12 respectively which are operative to continuously measure the pressures in the respective pipes and other conventional means to open the relief valves when the pressure of gas exceeds a preset level to directly release the gas from the piping to the atmospheric air and close the relief valve when the pressure is reduced below a predetermined level.

A process according to the invention for switching one gas to another will now be described. Assume that a gas within the piping 5' connected to the inner pipe 5 is desired to be switched from oxygen for blowing into argon for rinsing molten steel after the completion of such oxygen blowing. The gas in the piping 5' connected to the inner pipe 5 is blown into the converter 1 through each of tuyeres 4 at the bottom of the furnace in 3000 $Nm^3/Hr$ during blowing. Pressure control of the oxygen system is carried out by means of a pressure controlling valve 25 mounted on one of the first pipings in the valve station in such a manner that the oxygen controlled to a certain constant pressure is adjusted to a predetermined flow rate of 3000 $Nm^3/Hr$ by a flow controlling valve 20 and fed from the valve station through the single common piping 5' and the inner pipe 5 to the tuyere 4 at the bottom of the converter 1. Although there are slight variations in pressure value, the gas pressure in the pipings is substantially constant at about 5.5 $kg/cm^2$ during blowing. When the blowing is finished and the gas in the piping 5' is switched from oxygen to argon, the following steps are followed. The flow controlling valve 20 for oxygen and a flow controlling valve 21 for argon are each maintained at a predetermined value of opening and after the conditions of these valves are ascertained the control valve 20 for oxygen is closed to interrupt the supply of oxygen while keeping the control valve 21 for argon at the predetermined degree of opening. After ascertaining that the control valve 20 for oxygen is closed, the control valve 21 for argon succeeding the oxygen begins to control the flow of argon at a predetermined flow rate (3000 $Nm^3/Hr$ in this embodiment), thereby completing the switching.

In the switching process described hereinabove, the control valves 20 and 21 for oxygen and argon respectively are brought to an open position with certain degrees of opening and when they are both open, the flow rate of gas in the pipings becomes higher than the flow rate of oxygen of 3000 $Mn^3/Hr$ before switching is effected, thereby raising the pressure in the pipings as measured by the pressure gauge 11 to a level higher than the pressure in a steadystate. Thus by setting the pressure value for actuating the gas relief valve 7 in such a manner that it opens when the pressure value in the pipings reaches for example 7.5 $kg/cm^2$ to release gas and it closes when the pressure value drops to for example 7.0 $kg/cm^2$, it is possible to purge from the pipings the oxygen which is the gas to be replaced by the argon gas or to purge a mixture of oxygen and the argon which is to replace the oxygen remaining in the piping when gas replacements are carried out, by means of the relief valves.

In actual practice, the purging of the gas is effected substantially while only the succeeding argon flows through the pipings after the control valve 20 for the oxygen was closed in the gas replacing operation, and the purging of the gas can be accomplished in a time of several seconds, that is, the release valve is in an open stage several seconds. The time for purging the gas can be controlled by varying the pressure value at which the gas relief valve 7 is actuated and by varying the degree of the opening of valves for the preceding and succeeding gases, depending on the capacity of the pipings between the vlave station and the position at which the relief valve 7 is located. Alternatively, it is possible to effect such control of gas replacement by keeping the control valve 21 for the argon at a larger degree of opening than that in the steady state for a certain period of time after the control valve 20 for the oxygen to be replaced is closed or by keeping the flow rate of the succeeding argon at a higher level, such as 3500 $Nm^3/Hr$, for a certain period of time than the steadystate flow rate (which is 3000 $Mn^3/Hr$ in this embodiment) set for the argon immediately after gas replacements are connected, so that purging of the gas through the relief valve 7 can be positively carried out. The flow rate set for the argon is, of course, returned to 3000 $Nm^3/Hr$ for the steadystate condition after lapse of the certain period of time.

It is to be understood that the aforesaid process for switching one gas to another according to the invention can have application in the piping 6' connected to the outer pipe 6 shown in the drawing. Also, the same process can be used with the same results when switching of gases with respect to process using a porous plug or a single pipe tuyere from the blown gas to another is carried out.

The effects achieved by the embodiment of the invention shown in the drawing will be described specifically. In the embodiment shown in the drawing, the control valves 20 and 21 for switching the gases between oxygen and argon are spaced apart from the relief valve 7 mounted in the pipings by 75 meters in distance. In the prior art having no relief valve 7, it has taken a considerably long period of time to switch gases in this type of pipings. In the pipings connected to the outer pipe, a hydrocarbon is passed therethrough during the blowing of oxygen and then switched to argon for effecting the rinsing of molten steel. In the step of rinsing the molten steel by use of argon, the gas in the outer pipe is also switched to argon. The state at the tuyeres was observed to study the switching of hydrocarbon to argon by watching the combustion flames of the hydrocarbon at the forward end of the tuyere. When the relief valve 8 according to the invention was not mounted in the pipings connected to the outer pipe, it took from 25 to 45 seconds for the flames of hydrocarbon to disappear from the tuyere 4 at the bottom of the furnace after the gas in the pipings connected to the outer pipe was switched from the hydrocarbon to argon or, that is after the control valve 22 for the preceding hydrocarbon was closed by the same manipulation as described hereinabove with respect to the pipings connected to the inner pipe, although the time varied one tuyere-by-one tuyere depending on degree of clogging of the outer pipe of the tuyere. In other words, the time required for effecting gas replacements in the pipings connected to the outer pipe as judged by the disappearance of the flames of the hydrocarbon was in the range between 25 and 45 seconds. According to the inventor's experiences, when the forward end of the outer pipe was extremely clogged, the time sometimes exceeded one minute, and the time was further elongated in proportion to an increase in the capacity of the pipings when the distance between the valve station and the converter was increased.

On the other hand, in the present invention, gas replacements in the pipings provided with the relief valve 8 for the outer pipe were observed in the same manner described hereinabove as in the case of studying gas replacements in the pipings connected to the outer pipe with respect to the prior art. The results of the tests show that when the method according to the invention for carrying out switching of gases in the pipings was used, the time required for replacing gases in the pipings connected to the outer pipe was greatly shortened and became a period between 5 and 15 seconds. Substantially the same results were obtained with regard to the time required when the completion of switching the gas was judged on the basis of gas analysis in the pipings.

The aforesaid effects were also studied by the research of treatment for hydrogen removal at the time of rinsing being carried out by blowing argon into the molten steel. When a hydrocarbon is blown into the molten steel for cooling purposes through the tuyeres disposed at the bottom of the furnace at the same time as oxygen is blown thereinto as is the case with the embodiment of the present invention shown and described hereinabove, the hydrogen gas produced by decomposition of the hydrocarbon is partly absorbed by the molten steel to thereby increase the hydrogen content of the molten steel. The method of the prior art and the method according to the present invention for effecting gas switching in the pipings were compared with each other with regard to the results achieved in removing hydrogen by rinsing with argon carried out immediately after blowing. When the rinsing was carried out for two minutes, there was a marked difference between the two methods in which the hydrogen content of the molten steel was 3.4 ppm (mean value of 12 charges) in the prior art and the corresponding value for the present invention was 2.6 ppm (mean value of 9 charges). This difference in results is believed to be attributed to the fact that in the method of the prior art, the time required for the hydrocarbon in the outer pipe to be replaced completely by argon requires from 25 to 45 minutes although the time may vary slightly depending on the particular state of the tuyere, and a hydrogen source is constantly supplied to the molten steel by the gas blown thereinto during this time, so that hydrogen removal does not commence during the time of gas replacement. Thus it would be necessary regarding the method of the prior art to prolong the operation of the rinsing by a time corresponding to the prolonged time required for effecting gas replacements, in order that the same results as achieved by the method according to the present invention may be achieved to remove hydrogen from the molten steel. This would cause not only an increase in the cost of production because of an increase in argon consumption and a reduction in temperature but also an increased wear of the tuyere due to damage that might be caused thereto by the prolongation of the time for blowing argon therethrough into the molten steel, thereby raising a serious problem in operation.

Further, additional advantageous effect is obtained by such characterized point of the present invention that, at the time of the switching of gas in a case of blowing successively in turn two or more kinds of gases from each of tuyeres, the gas replacement can be relatively precisely controlled because of very shortened gas replacement period of time and very small variation in the gas replacement period of time in comparison with the conventional process. For example, in a case where oxygen is blown through the inner pipe of the tuyere while hydrocarbon such as propane is blown through the outer pipe thereof as a cooling agent for protecting the tuyere, an exothermic reaction between oxygen and molten steel and an endothermic reaction caused by the decomposition of the hydrocarbon are balanced thermally without causing the overheat of the tuyere by controlling the flow rates of the hydrocarbon and oxygen in an appropriate ratio. However, at the time of the gas switching, there is a fear that the thermal balance might be lost at the vicinity of the tuyere tip. That is, in the case of gas switching from a combination or pair of oxygen and hydrocarbon to another combination of argon and argon, if the hydrocarbon in the outer pipe and the piping connected thereto is replaced by argon earlier than the oxygen gas in the inner pipe, and another piping connected thereto is replaced by argon, the combination of the gases becomes oxygen-and-argon which immediately cause the very rapid increase of temperature in the vicinity of the tuyere tip. The small cooling ability of argon gas, may result in the damage of the tuyere due to high temperature.

On the other hand, at the time of switching gases from a combination of argon and argon to another combination of oxygen and hydrocarbon, if the gas replacement in the inner pipe and the piping connected thereto from argon to oxygen is completed earlier than the gas replacement in the outer pipe and another piping connected thereto from argon to hydrocarbon, the same fear of damage to the tuyere is caused by the combination of oxygen and argon.

Hitherto, since the gas switching according to the conventional process required a long period of time and the time necessary for the gas switching varies in a large degree depending on the condition of the outlet of the tuyere, it has been very difficult to completely prevent damage to the tuyere from occurring. However, according to the present invention, in the case of switching the argon and argon combination to the oxygen and hydrocarbon combination, the argon in the outer pipe and the piping connected thereto is first replaced by hydrocarbon and then, after the elapse of the time required to switch the argon to hydrocarbon, argon in the inner tube and the piping connected thereto is switched to oxygen, so that extreme thermally unbalanced condition caused at the outlet of the tuyere by the combination of oxygen and argon can be prevented. Such additional advantageous effect is very important particularly in prolongation of the service life of the tuyere and of achieving the stable operation of a converter by preventing trouble with the tuyere from occurring.

The method according to the invention for effecting gas replacements in the piping quickly and effectively when gas in the piping is switched from one to another can achieve excellent results in accomplishing the metallurgical object by bottom-blowing of gas and in maintaining the stability of gas blowing tuyeres and prolongation of their service life.

It is to be understood that the effects achieved by the invention are not confined to those achieved by the embodiment shown and described hereinabove, nor is the invention limited to the possible applications referred to hereinabove. The arrangement is also included in the scope of the invention in which arrangement relief valves are mounted as close as possible to the tuyere at the bottom of the converter and operate such that, when gas replacements in the piping are carried out, the relief valves are actuated by a rise in the pressure of gas in the piping to initiate release of the gas from the piping to achieve excellent effect in gas purging and de-actuated when the internal pressure of the piping drops, or by means of a timer.

What is claimed is:

1. A method of switching bottom blown gases successively from a first gas to a second gas without interruption immediately after the blowing of said first gas into a molten metal in a steel making furnace, which blowing is effected from tuyeres or porous plugs through piping means connecting the tuyeres or porous plugs to gas sources, said tuyeres or porous plugs being disposed at a part of the steel making furnace below the surface of the molten metal, comprising the steps of:

increasing the pressure of gas in the piping means to a higher level than a steadystate gas pressure flow condition which occurs when switching from the first gas to the second gas is completed;

releasing into the atmosphere at least a portion of the gas in the piping means from a predetermined position in the piping means between the gas sources and said furnace when the pressure of the gas is increased to exceed said predetermined level higher than the gas pressure in the steadystate flow condition whereby gas in said piping means is diverted from said furnace into the atmosphere; and inhibiting the release of the gas into the atmosphere after a lapse of a predetermined period of time from the initiation of the release of the gas, or when the pressure of the gas flowing through the piping drops below a predetermined level.

2. A method as claimed in claim 1, wherein the direct release of the gas from the piping means into the atmosphere is carried out at a position in the piping which is adjacent the furnace.

3. A method as claimed in claim 1, wherein each of the tuyeres or porous plugs is provided with two or more gas passages independent of each other, the gas switching regarding the first gas passages provided in each of the tuyeres or porous plugs being commenced with a time-lag with respect to the time of the commencement of other gas switching regarding the second gas passages.

4. An apparatus for switching bottom blown gases successively without interruption from a first gas to a second gas immediately after the blowing of said first gas into a molten metal in a steel making furnace, which blowing is effected from tuyeres or porous plugs disposed at a part of the steel making furnace below the surface of the molten metal, said blown gases being fed from a plurality of gas supply sources comprising:

first piping means connected to each of said plurality of gas supply sources;

means mounted in said first piping means for controlling the pressure and the flow rate of the gases flowing therethrough;

second piping means for operatively connecting said first piping means to the plurality of tuyeres or porous plugs;

and means located in a position in said second piping means between said gas sources and said furnace releasing into the atmosphere the gas flowing therethrough before said gas reaches said furnace when the pressure of the gas reaches a predetermined level.

5. A piping apparatus as claimed in claim 4, wherein said means for releasing the gas into the atmosphere comprises at least one gas relief valve and at least one means for adjusting the flow rate of the released gas.

6. A piping apparatus as claimed in claim 4, wherein said means for releasing the gas into the atmosphere is located at an end portion of said second piping means adjacent the steel-making furnace.

7. A piping apparatus as claimed in claim 4, wherein said means for controlling the pressure and the flow rate of the gas located in said first piping means comprises at least one pressure regulating valve or at least one flow rate control valve.

8. A piping apparatus as claimed in claim 4, wherein each of the tuyeres or porous plugs is provided with two or more gas passages independent of each other, the first gas passages provided in each of the tuyeres or porous plugs being connected to a first group of gas supply sources through said first and second piping means, the second gas passages in each of the tuyeres or porous plugs being connected to a second group of gas supply sources through another of said first and second piping means.

* * * * *